US008331826B2

(12) United States Patent
Minaminaka

(10) Patent No.: US 8,331,826 B2
(45) Date of Patent: Dec. 11, 2012

(54) COVER OPENING/CLOSING STRUCTURE AND IMAGE FORMING APPARATUS

(75) Inventor: Kazuyoshi Minaminaka, Suzuka (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 722 days.

(21) Appl. No.: 12/497,421

(22) Filed: Jul. 2, 2009

(65) Prior Publication Data

US 2010/0003050 A1 Jan. 7, 2010

(30) Foreign Application Priority Data

Jul. 4, 2008 (JP) ..... 2008-175962
May 27, 2009 (JP) ..... 2009-127595

(51) Int. Cl.
*G03G 15/00* (2006.01)
*G03G 21/00* (2006.01)

(52) U.S. Cl. ..... 399/110; 399/124

(58) Field of Classification Search ..... 399/107, 399/110, 122, 124, 400, 405, 125
See application file for complete search history.

(56) References Cited

U.S. PATENT DOCUMENTS 7,079,806 B2 * 7/2006 Baek et al. ..... 399/405
7,379,687 B2 * 5/2008 Kawasumi ..... 399/110
7,551,876 B2 * 6/2009 Kurita ..... 399/110
7,590,370 B2 * 9/2009 Yano ..... 399/110
7,636,530 B2 * 12/2009 Kitamura et al. ..... 399/107
7,704,001 B2 * 4/2010 Igarashi ..... 400/691
7,706,719 B2 * 4/2010 Kiyama ..... 399/110

FOREIGN PATENT DOCUMENTS

JP 07248716 A * 9/1995
JP 2002-052783 A 2/2002
JP 2005289523 A * 10/2005
JP 2007017658 A * 1/2007
JP 2008137764 A * 6/2008

* cited by examiner

*Primary Examiner* — Robert Beatty
(74) *Attorney, Agent, or Firm* — Baker Botts L.L.P.

(57) ABSTRACT

In an image forming apparatus, a cover opening/closing structure includes a first cover and a second cover which are rotatably attached to a main body. A rotation locus of an end part of the second cover interferes with a rotation locus of an end part of the first cover. At least one of the first cover and the second cover includes an operating surface which, when the second cover is rotated from a closed position toward an open position in a half-opened state of the first cover in which the end part of the first cover interferes with the rotation locus of the end part of the second cover, receives a pressing force in a direction causing the first cover to become either one of an open position and a closed position by the end part of the first cover contacting the end part of the second cover.

14 Claims, 10 Drawing Sheets

COVER OPENING/CLOSING STRUCTURE AND IMAGE FORMING APPARATUS

CROSS-REFERENCE TO RELATED APPLICATION

This application claims priority from Japanese Patent Application Nos. 2008-175962, filed on Jul. 4, 2008, and 2009-127595, filed on May 27, 2009, the entire subject matter of which is incorporated herein by reference.

TECHNICAL FIELD

Aspects of the present invention relate to a cover opening/closing structure including a first cover and a second cover capable of opening and closing with respect to two surfaces of an apparatus body, respectively, and an image forming apparatus including the cover opening/closing structure.

BACKGROUND

An image forming apparatus such as a printer includes a plurality of openable and closable covers on an outer surface of an apparatus body for the purposes of replacement of toner cartridges, maintenance such as recovery from sheet jamming, a change in discharge place of sheets, or the like.

In the apparatus, when one cover is opened, another cover is simultaneously opened. Specifically, when one cover is opened, a snap fit for engagement with the apparatus body in the other cover is smoothly released so that the other cover opens, and thus the other cover does not become an obstacle to opening and closing of the one cover. According to this configuration, the other cover that does not need to be opened is forcibly opened when the one cover is opened, which is inconvenient.

Generally, each cover is provided to the apparatus body so as to be openable and closable independently. In this configuration, it is necessary to provide the covers with space therebetween so as not to interfere with each other when opening a cover.

However, for the purpose of reducing size of the apparatus body, it is necessary to provide the covers closely. In this case, one cover can be opened and closed without interference in a state where another cover is closed. However, in a state where the other cover is kept at a half-opened state, when the one cover is opened, a rotation locus of the one cover may interfere with the other cover. As a result, the one cover and the other cover collide with each other so that the covers could be damaged. Specifically, in the apparatus in which the other cover is engaged to the apparatus body with two engaging parts (e.g., snap fit) in a closed position, if one of the engaging parts is released so that the other cover is in the half-opened state, the other cover is inclined with respect to a surface of the apparatus body and interferes with the rotation locus of the one cover.

SUMMARY

Accordingly, it is an aspect of the present invention to provide a cover opening/closing structure and an image forming apparatus including the same which can suppress the damage to covers.

According to an exemplary embodiment of the present invention, there is provided an image forming apparatus comprising: an apparatus body including a first surface and a second surface substantially orthogonal to the first surface; an image forming unit provided in the apparatus body; a sheet conveying unit which conveys a sheet through the image forming unit; a first cover provided to the apparatus body movably between a closed position and an open position with respect to the first surface, the first cover including a first end part and a second end part opposite to the first end part; and a second cover provided to the apparatus body movably between a closed position and an open position with respect to the second surface, the second cover including a third end part and a fourth end part opposite to the third end part. The first cover is rotatable about a first shaft extending in a direction parallel to the first surface and the second surface at the first end part, the first end part is positioned away from the second cover, and the second end part is positioned close to the second cover. The second cover is rotatable about a second shaft extending in a direction substantially parallel to the first shaft on a side closer to the third end part than the fourth end part, the third end part of the second cover is positioned closer to the first surface than the second shaft, and a rotation locus of the third end part of the second cover interferes with a rotation locus of the second end part of the first cover. At least one of the first cover and the second cover includes an operating surface which, when the second cover is rotated from the closed position toward the open position in a half-opened state of the first cover in which the second end part of the first cover interferes with the rotation locus of the third end part of the second cover, receives a pressing force in a direction causing the first cover to become either one of the open position and the closed position by the second end part of the first cover contacting the third end part of the second cover. The first cover includes a tray on which the sheet conveyed by the sheet conveying unit is discharged when the first cover is in the open position. The second cover is configured to open an opening of the apparatus body through which the image forming unit is exposed outside when the second cover is in the open position.

According to another exemplary embodiment of the present invention, there is provided an image forming apparatus comprising: an apparatus body including a side surface having a first opening and a top surface having a second opening; an image forming unit provided in the apparatus body; a sheet conveying unit which conveys a sheet through the image forming unit; a first cover rotatably positioned to open and close the first opening, the first cover including an end part; and a second cover rotatably positioned to open and close the second opening, the second cover including an end part. The first cover and the second cover are positioned such that a rotation locus of the end part of the first cover crosses a rotation locus of the end part of the second cover. The end part of one of the first and second covers includes a rib having an inclined surface along which the end part of the other of the first and second covers moves. When the second cover is in an open position, the image forming unit is exposed outside, and when the second cover is in a closed position, the sheet conveyed by the sheet conveying unit is discharged to a tray on the second cover. When the first cover is in the closed position, the first cover configures a part of the sheet conveying unit which conveys the sheet to the tray, and when the first cover is in the open position, a part of the sheet conveying unit is exposed.

According to another exemplary embodiment of the present invention, there is provided a cover opening/closing structure comprising: a main body including a side surface having a first opening and a top surface having a second opening; a first cover rotatably positioned to open and close the first opening, the first cover including an end part; and a second cover rotatably positioned to open and close the second opening, the second cover including an end part. The first cover and the second cover are positioned such that a rotation locus of the end part of the first cover crosses a rotation locus of the end part of the second cover. The end part of one of the first and second covers includes a rib having an inclined surface along which the end part of the other of the first and second covers moves.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Figure 1:
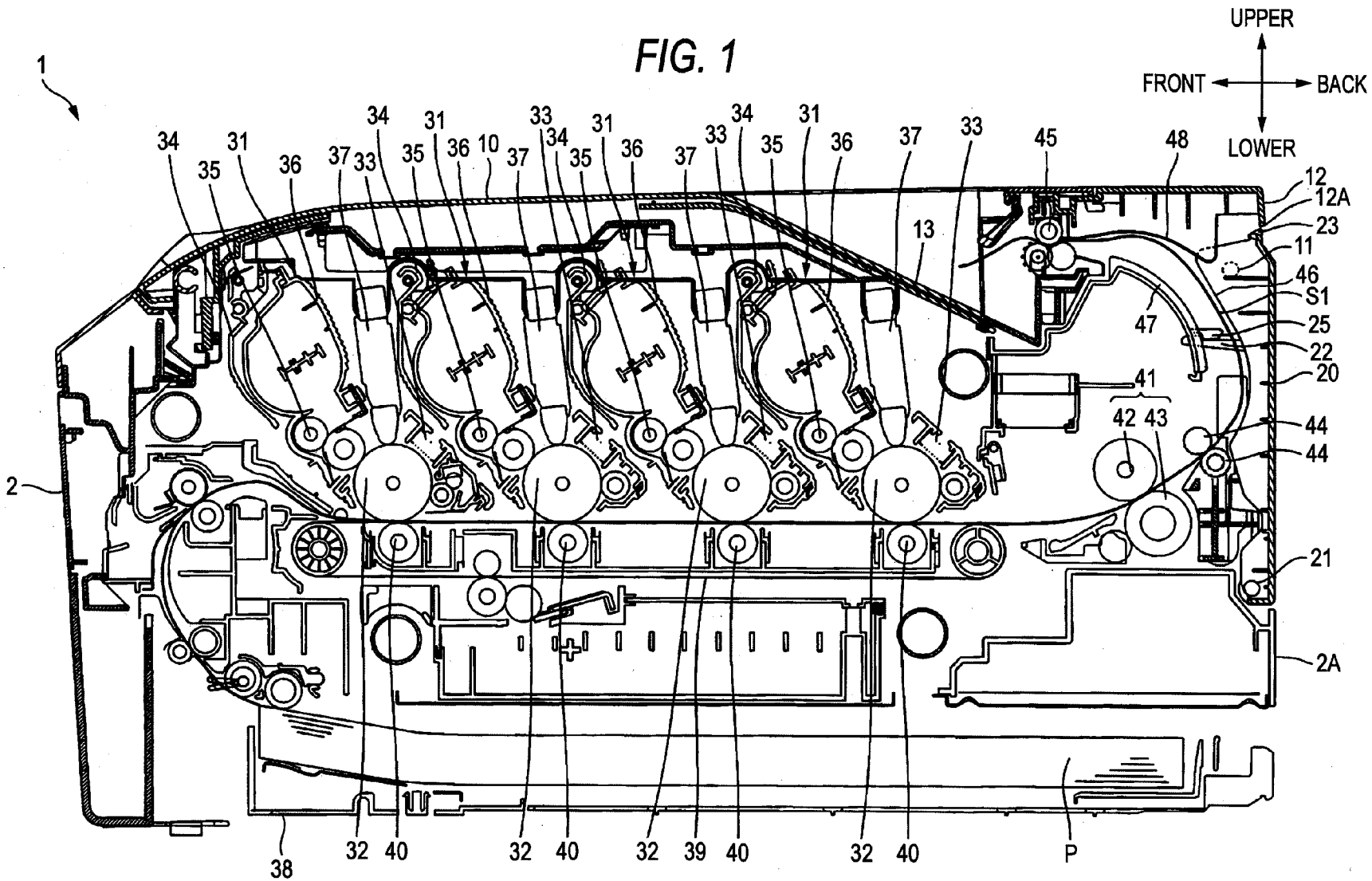
FIG. 1 is a sectional view of a printer according to an exemplary embodiment of the present invention.

Hereinafter, there will be described a cover opening/closing structure and an image forming apparatus, which is a tandem-type color printer according to an exemplary embodiment of the present invention. In this specification, as shown in FIG. 1, the front and back directions, and the upper and lower directions in normal use of the printer are taken as the front and back directions, and the upper and lower directions, respectively. Additionally, the directions orthogonal to the drawing sheet of FIG. 1 are taken as the right and left directions. In FIG. 2 to FIG. 10, illustration of a part of internal devices in the image forming apparatus will be omitted.

(1) Overall Configuration

The printer 1 according to the exemplary embodiment is shown in FIG. 1. The printer 1 includes a body casing 2 as an apparatus body which has a substantially hexahedral box shape. The body casing 2 includes a top plate 10 (an example of a second cover) openably and closably provided at a top surface thereof, and a first cover 20 openably and closably provided at a back surface 2A which is one of side surfaces extending in the upper and lower directions and substantially orthogonal to the top surface. In other words, the top plate 10 is provided to the body casing 2 movably between a closed position and an open position with respect to the top surface, and the first cover 20 is provided to the body casing 2 movably between a closed position and an open position with respect to the back surface 2A.

The body casing 2 includes an image forming unit and a sheet conveying unit which conveys a sheet through the image forming unit inside the body casing 2. In the body casing 2, the image forming unit includes four process cartridges 31 of black, yellow, magenta, and cyan, and respective exposure heads 37 opposing photosensitive drums 32 provided in the process cartridges 31. The process cartridges 31 and the exposure heads 37 are disposed in pairs and in tandem in a sheet conveying direction. Further, the image forming unit includes a fixing unit 41, which is provided downstream of the pairs of process cartridges 31 and the exposure heads 37 in the sheet conveying direction.

Each process cartridge 31 includes a drum cartridge 34 and a developing cartridge 36 which is detachably attached to the drum cartridge 34. The drum cartridge 34 holds a photosensitive drum 32 and a scorotron-type charger 33, and the developing cartridge 36 includes a developing roller 35 and toner of a predetermined color. The surface of the photosensitive drum 32 is uniformly charged by the scorotron-type charger 33, and then selectively exposed by an LED array provided in the exposure unit 37. Thereby, an electrostatic latent image based on image data is formed on the surface of each photosensitive drum 32. Each electrostatic latent image is made visible by toner carried on the developing roller 35, so that a toner image is formed on the surface of the photosensitive drum 32.

The sheet conveying unit includes a sheet feeding tray 38 which accommodates a stack of sheets P, a conveying belt 39 which conveys a sheet P in an arrangement direction of the photosensitive drums 32 so that the sheet P sequentially contacts the plurality of photosensitive drums 32, conveying rollers 44 which conveys the sheet P on which an image is fixed, a discharge path S1, and a discharge rollers 45.

An uppermost sheet P accommodated in the sheet feeding tray 38 is singly separated from the stack of sheets P and fed onto the conveying belt 39 by a plurality of rollers in a known manner. Then, by a transfer bias applied to a transfer roller 40 opposing a photosensitive drum 32 with the conveying belt 39 interposed therebetween, a toner image formed on the photosensitive drum 32 is transferred onto the sheet P. The sheet P on which the toner image is transferred is conveyed to the fixing unit 41, and the toner image is fixed on the sheet P by a heating roller 42 and a pressure roller 43 in a known manner. Thereafter, the sheet P on which the toner image is fixed is conveyed to the conveying rollers 44 and discharged onto a tray 13 formed on the top surface of the top plate 10 by the discharge roller 45 through the discharge path S1.

The discharge path S1 is defined between a curved guide plate 47 provided in the body casing 2, guide ribs 46 formed on the first cover 20 and guide ribs 48 formed on the top plate 10 when the first cover 20 is in a closed position and the top plate 10 is in a closed position. Accordingly, the sheet P conveyed by the conveying rollers 44 is guided toward the discharge rollers 45 through the discharge path S1 while curved in a U-shape.

(2) Configuration of First Cover 20 and Top Plate 10

Figure 3:
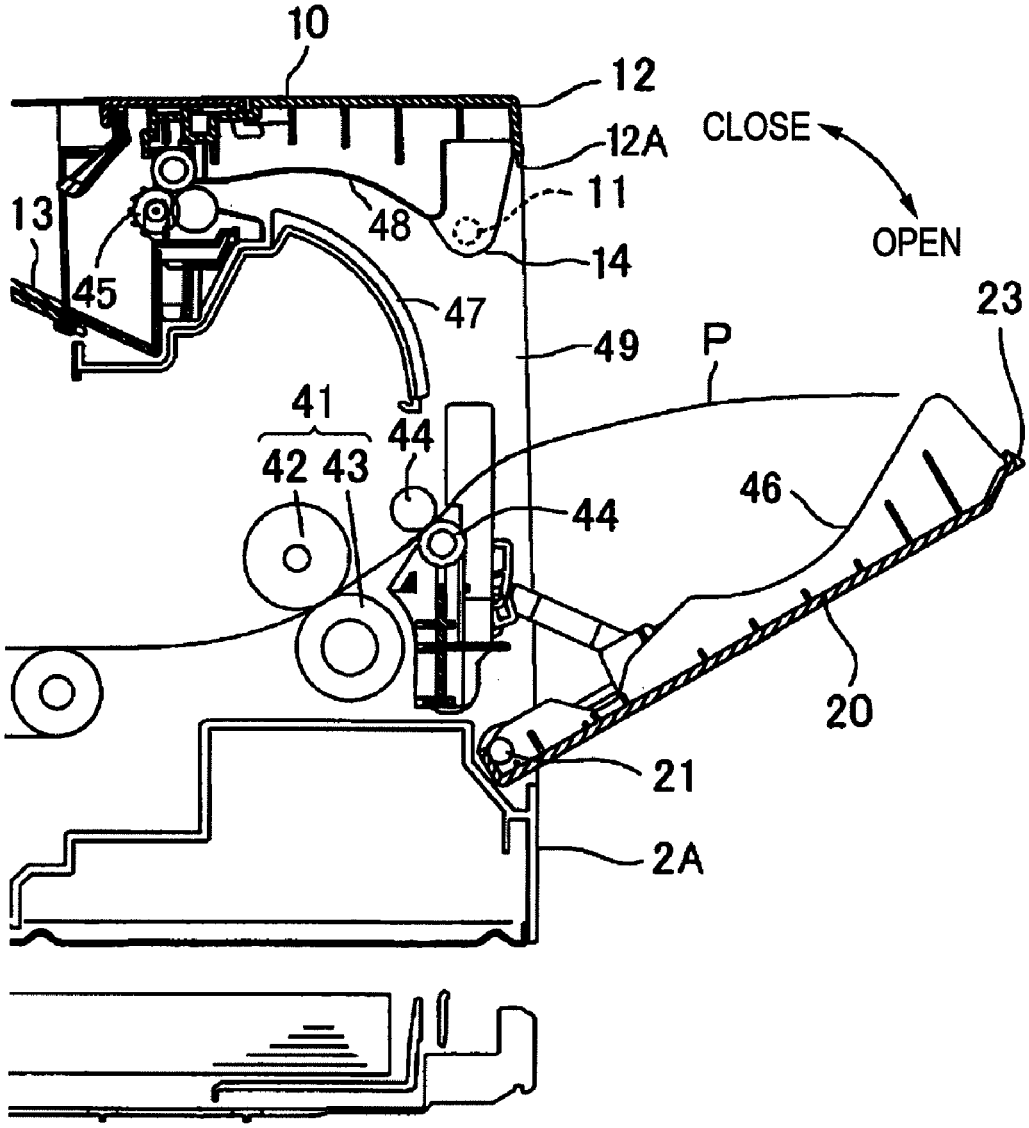
FIG. 3 is a sectional view showing a state where a first cover is open in the printer of FIG. 1.

As shown in FIG. 3, the body casing 2 has an opening portion 49 at the back surface 2A so that a part of the discharge path S1 is exposed backwardly. A top part of the opening portion 49 is opened upwardly from the body casing 2 and defined by the top plate 10. The first cover 20 is provided so as to open and close the opening portion 49. Specifically, the first cover 20 is attached to the body casing 2 rotatably about a rotating shaft 21 at a lower side thereof, which is a side away from the top plate 10 and referred to as a lower end part. The rotating shaft 21 extends in a direction (the left and right direction) parallel to the back surface 2A and the top surface of the body casing 2. A top part of the first cover 20 opposite to the lower end part is positioned close to the top plate 10 when the first cover 20 is in the closed position.

Figure 2:
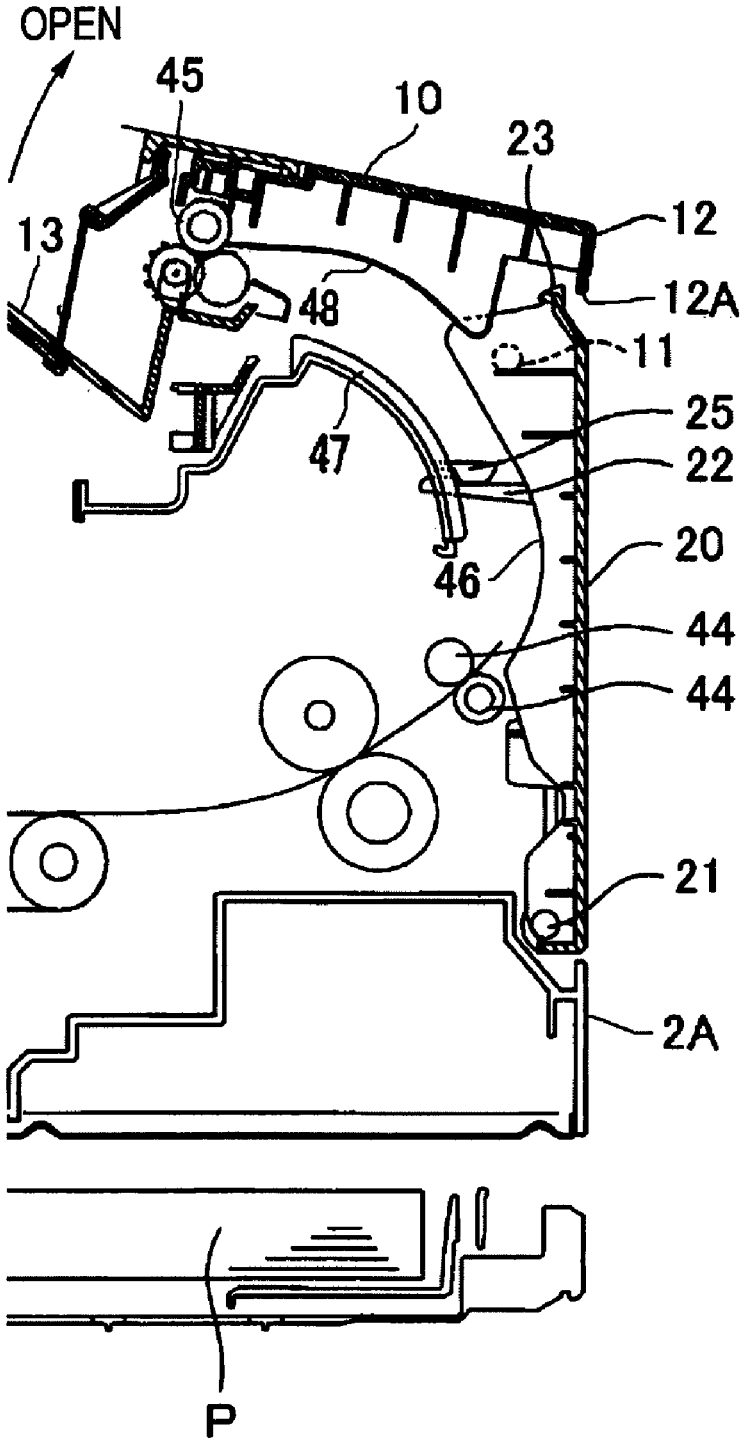
FIG. 2 is a sectional view showing a state where a top plate is opened in the printer of FIG. 1.
Figure 5:
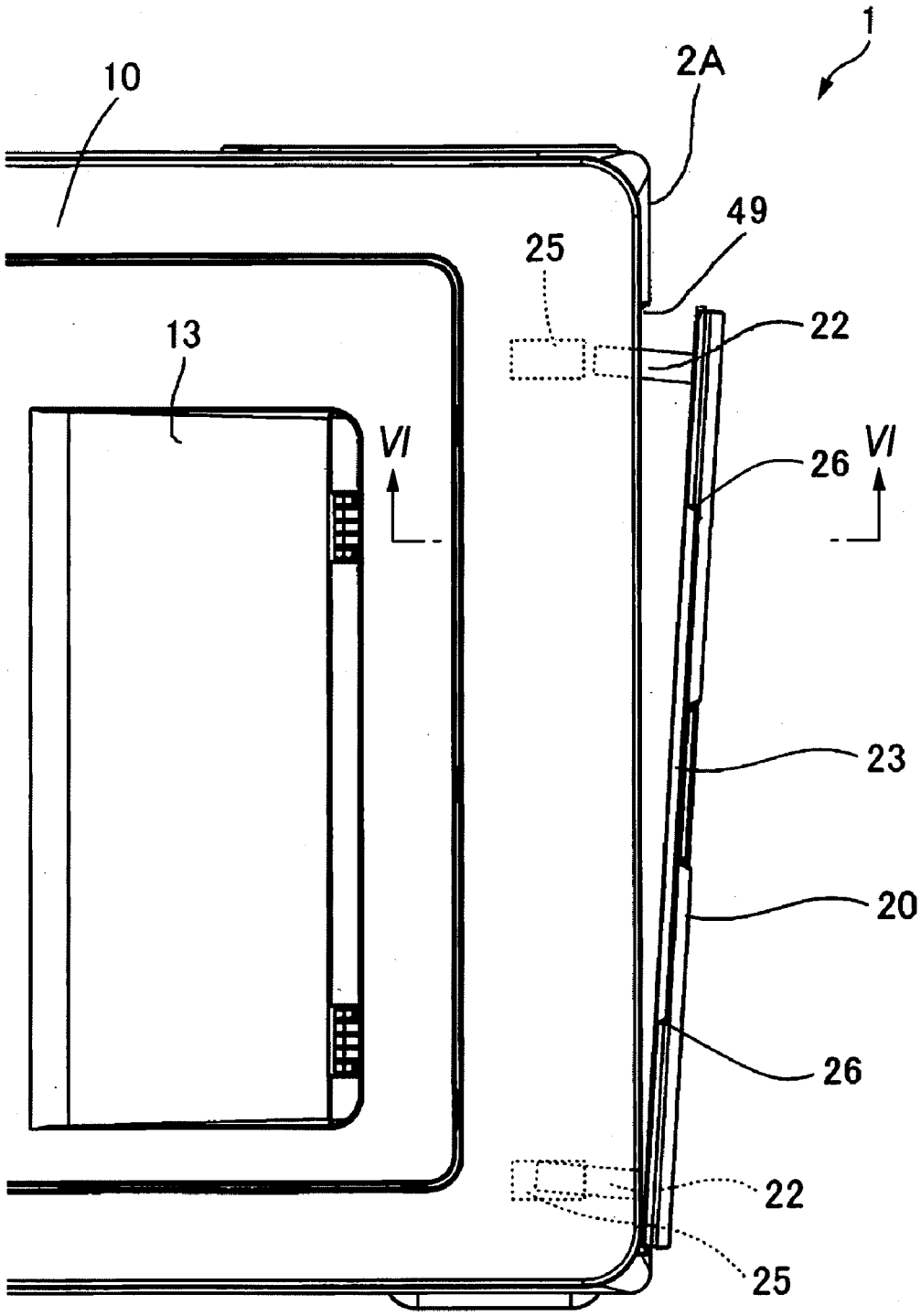
FIG. 5 is a top view of the printer when the first cover is in a half-opened state.

The first cover 20 is formed with the plurality of guide ribs 46 on a side of the first cover 20 facing the body casing 2 when the first cover 20 is in the closed position in which the opening portion 49 is closed. The guide ribs 46 extend from the conveying roller 44 toward the guide ribs 48 of the top plate 10. As shown in FIGS. 1, 2, and 5, the first cover 20 and the body casing 2 are provided with a pair of engaging parts 22 and a pair of engagement receivers 25, respectively, for holding the first cover 20 in the closed position. The engaging parts 22 of the first cover 20 are provided in positions closer to the top part than the rotating shaft 21. The engaging parts 22 are spaced apart by a distance greater than the width of a sheet P in a direction (the left and right direction) parallel to the rotating shaft 21, and extend toward the opening portion 49. The engagement receivers 25 of the body casing 2 are provided so as to oppose the respective engaging parts 22, when the first cover 20 is in the closed position.

Figure 4A:
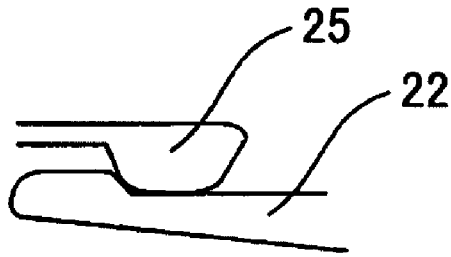
FIGS. 4A to 4C are side views showing engagement states of an engaging part and an engagement receiver.
Figure 4B:
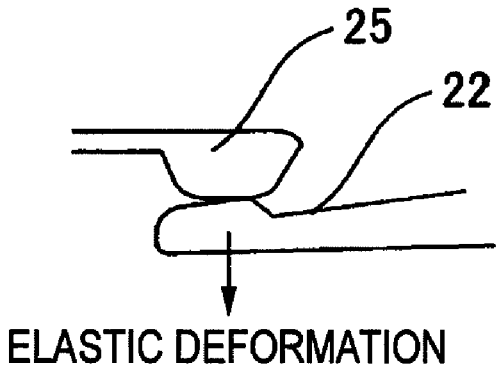
Figure 4C:
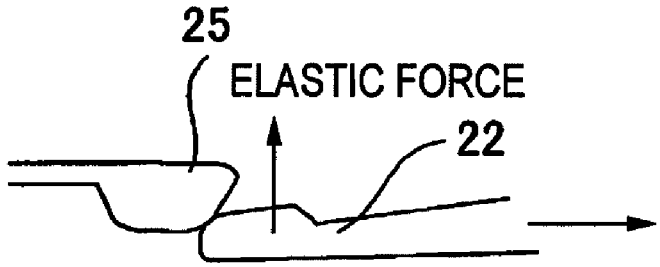

As shown in FIGS. 4A to 4C, the facing surfaces of the engaging parts 22 and the engagement receivers 25 are formed with projections, respectively. In the closed position of the first cover 20, as shown in FIG. 4A, the projections of each engaging part 22 and its corresponding engagement receiver 25 are located beyond each other to be engaged, so that the first cover 20 is held in the closed position. From this position, when the first cover 20 is rotated toward an open position, as shown in FIG. 4B, the engagement state of the projections becomes released while the engaging part 22 and the engagement receiver 25 are elastically deformed. Then, as shown in FIG. 4C, the inclined surfaces of the projections are pressed to each other by their elastic force, so that the first cover 20 is pressed toward the open position. Thereafter, as shown in FIG. 3, the first cover 20 is rotated backwardly about the rotating shaft 21 by gravity, and held by a known link member in the open position in which it is inclined at an acute angle with respect to the back surface 2A of the body casing 2.

In contrast, when the first cover 20 is rotated from the open position to the closed position, the projections of each engaging part 22 and its corresponding engagement receiver 25 move over each other to be engaged while the engaging part 22 and the engagement receiver 25 are elastically deformed, so that the first cover 20 is held in the closed position.

As shown in FIG. 5, when the first cover 20 is in a half-opened sate in which one of the two engaging parts 22 is engaged with the corresponding engagement receiver 25 and the other of the engaging parts 22 is released from the corresponding engagement receiver 25, the first cover 20 is elastically deformed and the top part thereof is inclined with respect to the back surface 2A of the body casing 2. In other words, in the half-opened state, the first cover 20 is inclined with respect to the back surface 2A so that one side end of the first cover 20 is closer to the back surface 2A than the other side end.

Figure 7A:
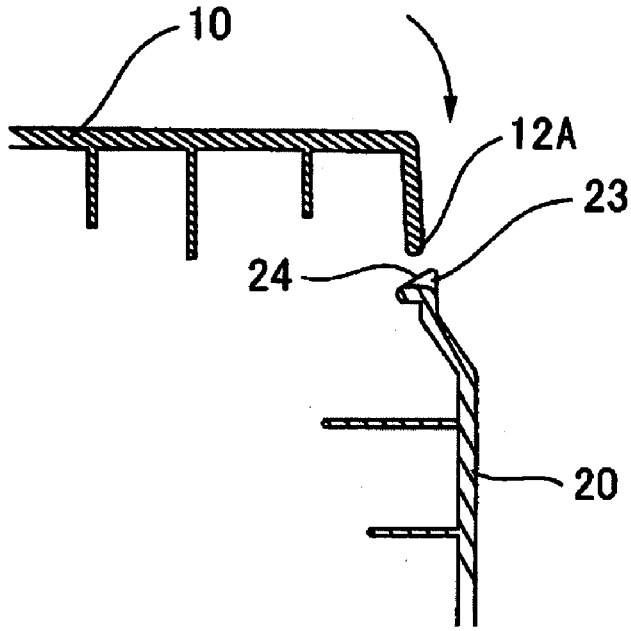
FIGS. 7A and 7B are enlarged sectional views showing a contact part between the top plate and the first cover.
Figure 7B:
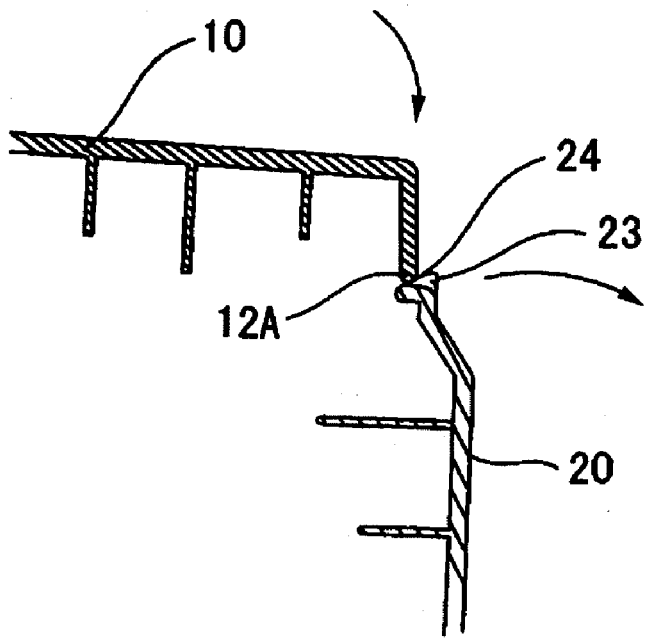
Figure 8:
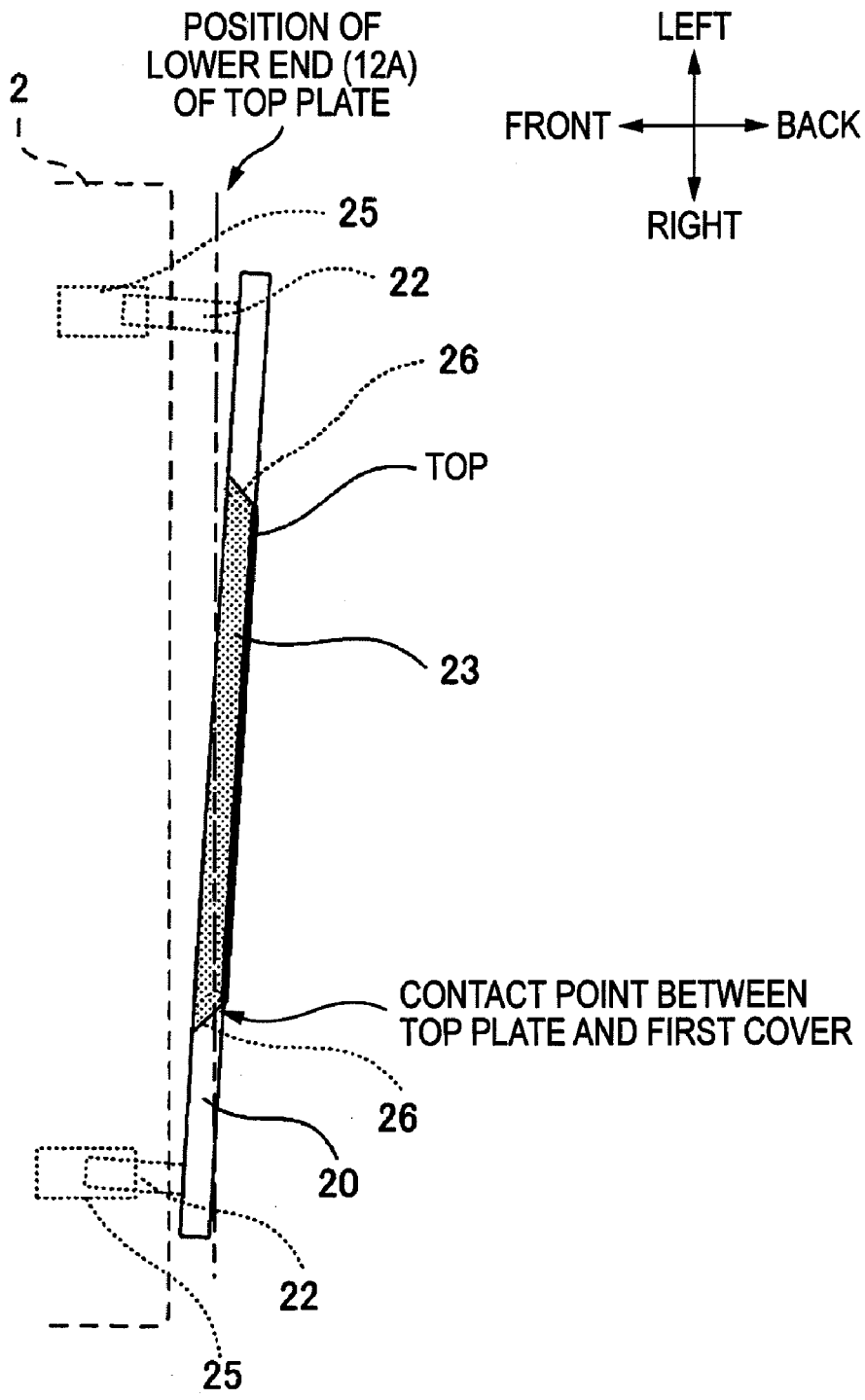
FIG. 8 is a top view of a top part of the first cover when viewed from the above.

As shown in FIGS. 7A and 7B, the top part of the first cover 20 is formed with a rib 23 which has a triangular cross-section and opposes a lower end 12A of the top plate 10 when the first cover 20 is in the closed position. The rib 23 has an operating surface 24 which intersects with (crosses) an arcuate surface extending about the rotating shaft 21 and which is inclined so that the front side (inside of the body casing 2) is lower than the back side thereof. Preferably, the length of the rib 23 in the direction parallel to the rotating shaft 21 is set so that, when the top plate 10 is rotated in a state where the first cover 20 is in the half-opened state as shown in FIG. 5, to the opened position, a rotation locus of the lower end 12A of the top plate 10 intersects with and contacts one of side ends 26 of the rib 23. As shown in FIG. 8, the side ends 26 of the rib 23 expand outwardly in the left and right direction toward the front side, that is, the lower side of the rib 23.

The top plate 10 is attached to left and right surfaces of the body casing 2 at the back end part thereof close to the first cover 20 so as to be rotatable about a rotating shaft 11 extending in a direction parallel to the rotating shaft 21. A back end surface 12 of the top plate 10 is positioned substantially on an imaginary extended surface of the back surface 2A of the body casing 2. The lower end 12A of the back end surface 12 is positioned close to the top part of the first cover 20.

As shown in FIG. 3, the top plate 10 includes side walls 14 on left and right sides thereof. Each of the side walls 14 extends lower than the lower end 12A and has the rotating shaft 11 projecting outwardly therefrom. That is, the rotating shaft 11 is provided forward of the back end surface 12 (toward the inside of the body casing 2) and at a position between the rotating shaft 21 and the top part of the first cover 20. Accordingly, the rotation locus of the lower end 12A of the top plate 10 intersects with (crosses) a rotation locus of the top part of the first cover 20 when the first cover 20 is in the half-opened state and the top plate 10 is rotated toward the open position. A front par of the top plate 10 opposite to the back end surface 12 from the rotating shaft 11 extends frontwardly so as to cover the image forming unit entirely when the top plate 10 is in the closed position.

(3) Operation of First Cover 20 and Top Plate 10

In a state where the first cover 20 and the top plate 10 are both in the closed position, the sheet P on which image formation has been performed is conveyed from the conveying rollers 44 and discharged to the tray 13 on the top plate 10 through the discharge path S1. The sheet P is placed on the tray 13 with the image side face down. In this course, when the sheet P is jammed around the conveying rollers 44 or the discharge roller 45, it is removed by rotating the first cover 20 into the open position.

On the other hand, as shown in FIG. 3, when the first cover 20 is in the open position, the discharge path S1, which is a part of the sheet conveying unit, is exposed outside backwardly, so that the sheet P conveyed by the conveying rollers 44 is discharged onto the first cover 20 in the open position as a discharge tray with the image side face up.

As shown in FIG. 2, when the top plate 10 is rotated around the rotating shaft 11 into the open position while the first cover 20 is in the closed position, the lower end 12A of the back end surface 12 of the top plate 10 is moved behind the first cover 20 without interference with the first cover 20. In this state in which the first cover 20 is in the closed position and the top plate 10 is in the open position, the process cartridges 31 and the developing cartridges 36 can be replaced or inspection can be performed.

Figure 6:
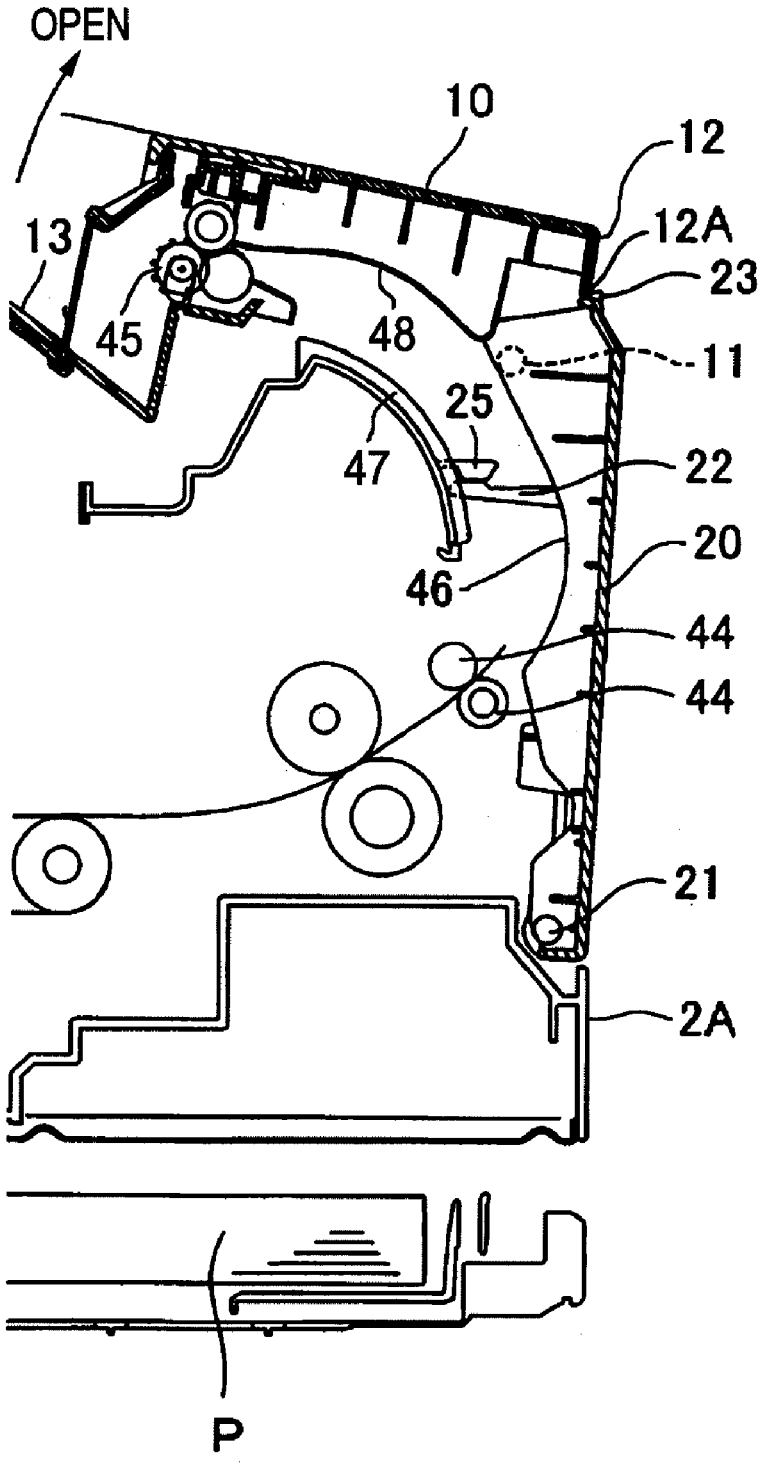
FIG. 6 is a sectional view taken along the line VI-VI of FIG. 5.
Figure 9:
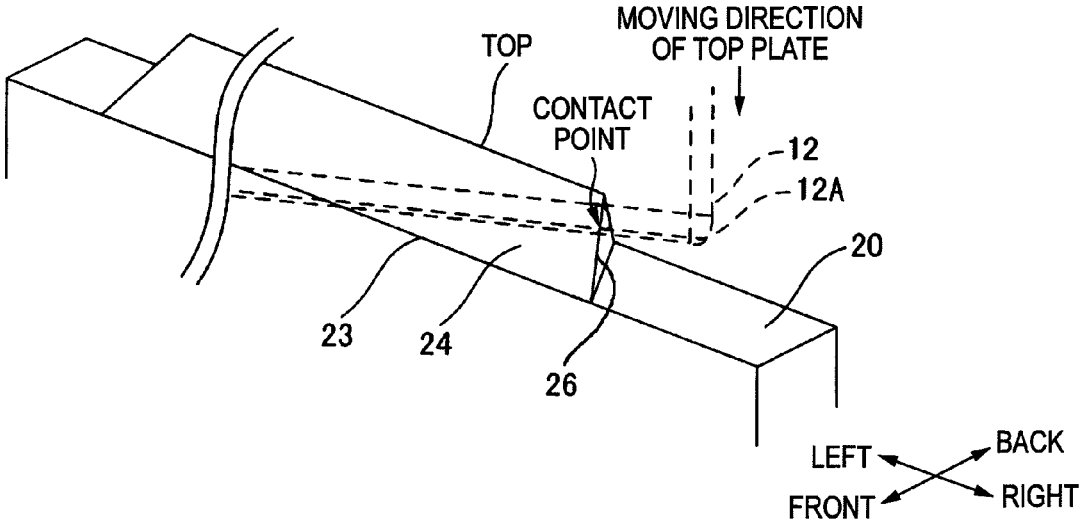
FIG. 9 is a perspective view of the top contact part of the first cover.

As shown in FIGS. 5 and 6, when the top plate 10 is rotated about the rotating shaft 11 in a state where the first cover 20 is in the half-opened state in which one of the engaging parts 22 is released from the corresponding engagement receiver 25 or the first cover 20 is inclined with respect to the back surface 2A of the body casing 2, the lower end 12A of the back end surface 12 of the top plate 10 contacts the top part of the first cover 20. In this course, as shown in FIGS. 8 and 9, the lower end 12A presses the inclined operating surface 24 and moves along the inclined operating surface 24, so that the first cover 20 is pressed backwardly to be rotated toward the open position about the rotating shaft 21. The amount of pressing the operating surface 24 by the lower end 12A is set in a range in which the engaged engaging part 22 is just released from the engagement receiver 25.

As described above, when the engaging part 22 is released from the engagement receiver 25, the first cover 20 is pressed toward the open position due to the elastic force of the engaging part 22 and the engagement receiver 25, and thereafter, the first cover 20 is tilted toward the open position by gravity. Accordingly, the first cover 20 can be rotated toward the open position while the lower end 12A does not contact any part of the top part of the first cover 20 outside the side ends 26 of the rib 23.

Therefore, when the top plate 10 is rotated to the open position, even if the top plate 10 collides with the first cover 20, damage to the top plate 10 and the first cover 20 can be reduced.

According to the above-described configuration, when the first cover 20 and the top plate 10 are in the closed position, the back end surface 12 of the top plate 10 is positioned substantially on an imaginary extended surface of the back surface 2A of the body casing 2, and the lower end 12A of the back end surface 12 is positioned close to the top part of the first cover 20. According to this configuration, it is possible to reduce a size of the printer 1 and the outer appearance of the back surface 2A of the body casing 2 becomes superior.

According to the above-described configuration, when the first cover 20 and the top plate 10 are in their closed position, the rotating shaft 11 of the top plate 10 is provided at a position between the rotating shaft 21 and the top part of the first cover 20. Therefore, the top part of the first cover 20 is provided much close to the back end part of the top plate 10, so that the outer appearance of the back surface 2A of the body casing 2 becomes superior. Additionally, even if the first cover 20 is in the half-opened state which is difficult to be noticed, the back end part of the top plate 10 contacts the top part of the first cover 20 to cause the first cover 20 to rotate into the open position. Therefore, it can be suppressed that the top plate 10 and the first cover 20 are damaged.

According to the above-described configuration, even if the first cover 20 is in the half-opened state in which one of the engaging parts 22 is released so that the top part of the first cover 20 is inclined, when the top plate 10 is rotated from the closed position to the open position, the back end part of the top plate 10 contacts the top part of the first cover 20 in a crossing position so that the first cover 20 is pressed toward the opened sate by an operation of the operating surface 24.

According to the above-described configuration, since the operating surface 24 is inclined so that the front side is lower than the back side thereof, it is possible to press the first cover toward the open position when the top part of the first cover 20 contacts the back end part of the top plate 10.

According to the above-described configuration, the first cover 20 provided to the back surface 2A tends to be in the half-opened state by gravity. However, in the half-opened state of the first cover 20, when the top plate 10 is rotated from the closed position to the open position, the back end part of the top plate 10 contacts the top part of the first cover 20 to cause the first cover 20 to become the open position. Therefore, it can be suppressed that the top plate 10 and the first cover 20 are damaged.

(4) Modified Exemplary Embodiment

Figure 10A:
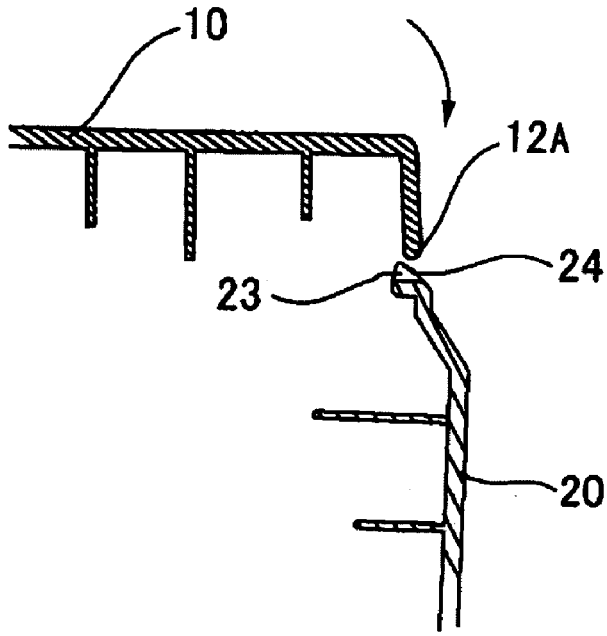
FIGS. 10A and 10B are enlarged sectional views corresponding to FIGS. 7A and 7B in a modified exemplary embodiment.
Figure 10B:
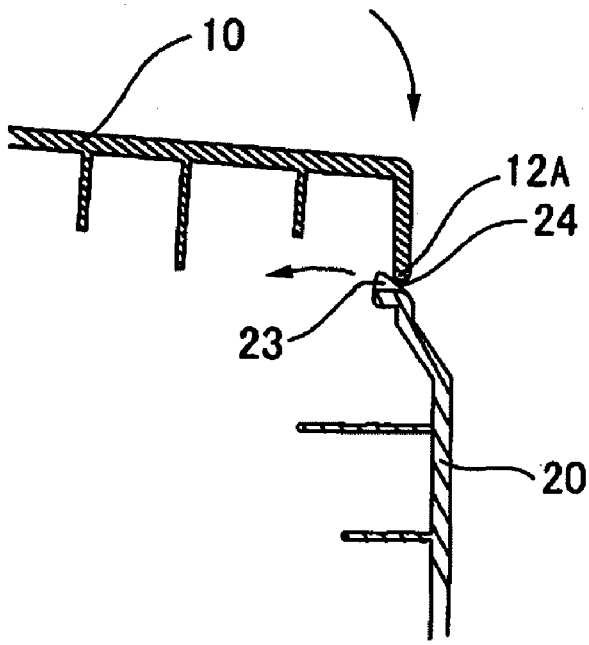

In the above-described exemplary embodiment, when the top plate 10 is rotated to the open position, the first cover 20 in the half-opened state is pressed toward the open position. However, the present invention is not limited thereto. That is, the first cover 20 in the half-opened state may be pressed toward the closed position when the top plate 10 is rotated to the open position. In this case, the inclination of the operating surface 24 of the rib 23 is formed so that the front side (inside of the body casing 2) is higher than the back side thereof as shown in FIGS. 10A and 10B, which is opposite to the exemplary embodiment shown in FIGS. 7A and 7B.

Additionally, in the above-described exemplary embodiment, the operating surface 24 is formed at the top part of the first cover 20. However, the present invention is not limited thereto. The operating surface 24 may be provided on the lower end 12A of the top plate 10, alternatively, the operating surface 24 may be provided on both the lower end 12A and the rib 23. Further, the operating surface 24 may be inclined in a direction parallel to the rotating shaft.

Further, in the above-described exemplary embodiment, in the half-opened state of the first cover 20, one of the engaging parts 22 is released. However, the first cover 20 may be held in the half-opened state due to frictional force between the first cover 20 and the body casing 2.

Further, in the exemplary embodiment, a cover opening/closing structure of the image forming apparatus is described. However, the cover opening/closing structure can be applied to not only such an image forming apparatus but also various apparatuses having two covers.

Moreover, the operating surface 24 of the rib 23 on the above-described exemplary embodiment may be a plane or a curved surface.

What is claimed is:

1. An image forming apparatus comprising:

an apparatus body including a first surface and a second surface substantially orthogonal to the first surface;

an image forming unit provided in the apparatus body;

a sheet conveying unit which conveys a sheet through the image forming unit;

a first cover provided to the apparatus body movably between a closed position and an open position with respect to the first surface, the first cover including a first end part and a second end part opposite to the first end part; and a second cover provided to the apparatus body movably between a closed position and an open position with respect to the second surface, the second cover including a third end part and a fourth end part opposite to the third end part;

wherein the first cover is rotatable about a first shaft extending in a direction parallel to the first surface and the second surface at the first end part, the first end part is positioned away from the second cover, and the second end part is positioned close to the second cover, wherein the second cover is rotatable about a second shaft extending in a direction substantially parallel to the first shaft on a side closer to the third end part than the fourth end part, the third end part of the second cover is positioned closer to the first surface than the second shaft, and a rotation locus of the third end part of the second cover interferes with a rotation locus of the second end part of the first cover, wherein at least one of the first cover and the second cover includes an operating surface which, when the second cover is rotated from the closed position toward the open position in a half-opened state of the first cover in which the second end part of the first cover interferes with the rotation locus of the third end part of the second cover, receives a pressing force in a direction causing the first cover to become either one of the open position and the closed position by the second end part of the first cover contacting the third end part of the second cover, wherein the first cover includes a tray on which the sheet conveyed by the sheet conveying unit is discharged when the first cover is in the open position, and wherein the second cover is configured to open an opening of the apparatus body through which the image forming unit is exposed outside when the second cover is in the open position.

2. The image forming apparatus according to claim 1, wherein the third end part of the second cover includes an end surface positioned substantially on an imaginary extended surface of the first surface of the apparatus body, wherein the end surface of the second cover is positioned close to the second end part of the first cover when both of the first cover and the second cover are in the closed position.

3. The image forming apparatus according to claim 1, wherein the second shaft is provided at a position between the first shaft of the first cover and the second end part of the first cover when the second cover is in the closed position.

4. The image forming apparatus according to claim 1, wherein the first cover includes two engaging parts provided away from the first shaft and with a space therebetween in a direction parallel to the first shaft, and the engaging parts are configured to hold the first cover in the closed position by engaging with the apparatus body, wherein in the half-opened state of the first cover, one of the engaging parts is engaged with the apparatus body and the other of the engaging parts is released from the apparatus body, and the second end part of the first cover is inclined with respect to the first surface of the apparatus body, and wherein the third end part of the second cover contacts the second end part of the first cover inclined with respect to the first surface in a crossing state when the second cover is rotated from the closed position toward the open position.

5. The image forming apparatus according to claim 1, wherein the operating surface is inclined toward either one of an opening direction and a closing direction of the first cover.

6. The image forming apparatus according to claim 1, wherein the first surface is one of side surfaces of the apparatus body, which extends in an upper and lower direction, wherein the first end part of the first cover is positioned lower than the second end part of the first cover, and wherein the second surface is a top surface of the apparatus body.

7. The image forming apparatus according to claim 1, wherein the first cover is urged toward the open position by gravity, and wherein the operating surface receives the pressing force toward the open position of the first cover from the half-opened state by contacting the second cover.

8. An image forming apparatus comprising:

an apparatus body including a side surface having a first opening and a top surface having a second opening;

an image forming unit provided in the apparatus body;

a sheet conveying unit configured to convey a sheet through the image forming unit;

a first cover rotatably positioned to open and close the first opening, the first cover including an end part; and a second cover rotatably positioned to open and close the second opening, the second cover including an end part;

wherein the first cover and the second cover are positioned such that a rotation locus of the end part of the first cover crosses a rotation locus of the end part of the second cover, wherein the end part of one of the first and second covers includes a rib having an inclined surface such that the end part of the other of the first and second covers moves while contacting the inclined surface, wherein when the second cover is in an open position, the image forming unit is exposed outside, and when the second cover is in a closed position, the sheet conveyed by the sheet conveying unit is discharged to a tray on the second cover, and wherein when the first cover is in the closed position, the first cover configures a part of the sheet conveying unit which conveys the sheet to the tray, and when the first cover is in the open position, a part of the sheet conveying unit is exposed.

9. The image forming apparatus according to claim 8, wherein when the first cover is in the open position, the sheet conveyed by the sheet conveying unit conveys is discharged to the first cover.

10. The image forming apparatus according to claim 8, wherein the rib includes side ends which expand toward a lower side of the inclined surface.

11. The image forming apparatus according to claim 8, wherein the rib includes side ends, and one of the side ends is positioned at a portion which contacts the end part of the other of the first and second covers when the first cover is in a predetermined position in which the end part of the first cover is inclined with respect to the side surface of the apparatus body such that the one of the side ends is closer to the side surface than the other of the side ends.

12. A cover opening/closing structure comprising:

a main body including a side surface having a first opening and a top surface having a second opening;

a first cover rotatably positioned to open and close the first opening, the first cover including an end part; and a second cover rotatably positioned to open and close the second opening, the second cover including an end part;

wherein the first cover and the second cover are positioned such that a rotation locus of the end part of the first cover crosses a rotation locus of the end part of the second cover, and wherein the end part of one of the first and second covers includes a rib having an inclined surface such that the end part of the other of the first and second covers moves while contacting the inclined surface.

13. The cover opening/closing structure according to claim 12, wherein the rib includes side ends which expand toward a lower side of the inclined surface.

14. The cover opening/closing structure according to claim 12, wherein the rib includes side ends, and one of the side ends is positioned at a portion which contacts the end part of the other of the first and second covers when the first cover is in a predetermined position in which the end part of the first cover is inclined with respect to the side surface of the main body such that the one of the side ends is closer to the side surface than the other of the side ends.

* * * * *